US008816997B2

(12) United States Patent
Tokuda et al.

(10) Patent No.: US 8,816,997 B2
(45) Date of Patent: Aug. 26, 2014

(54) IMAGE DISPLAY DEVICE

(75) Inventors: Naoki Tokuda, Mobara (JP); Atsushi Hasegawa, Togane (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 850 days.

(21) Appl. No.: 12/717,975

(22) Filed: Mar. 5, 2010

(65) Prior Publication Data

US 2010/0231615 A1 Sep. 16, 2010

(30) Foreign Application Priority Data

Mar. 10, 2009 (JP) ..... 2009-056501

(51) Int. Cl.
*G09G 5/00* (2006.01)

(52) U.S. Cl.
USPC ..... 345/204; 345/205; 345/690; 345/80; 345/82

(58) Field of Classification Search
CPC ..... G09G 2300/04
USPC ..... 345/204, 205, 690, 80, 82
See application file for complete search history.

(56) References Cited

U.S. PATENT DOCUMENTS 4,409,722 A * 10/1983 Dockerty et al. ..... 438/283
6,072,517 A * 6/2000 Fork et al. ..... 347/237
6,137,523 A * 10/2000 Fork ..... 347/237
6,469,317 B1 * 10/2002 Yamazaki et al. ..... 257/59
6,522,079 B1 2/2003 Yamada
6,771,028 B1 * 8/2004 Winters ..... 315/169.1
7,710,022 B2 * 5/2010 Cok et al. ..... 313/505
2002/0160546 A1 10/2002 Nozawa et al.
2003/0089905 A1 * 5/2003 Udagawa et al. ..... 257/40
2003/0146712 A1 * 8/2003 Inukai ..... 315/169.3
2003/0205968 A1 11/2003 Chae et al.
2004/0257312 A1 * 12/2004 Koyama et al. ..... 345/76
2005/0040441 A1 * 2/2005 Kimura ..... 257/249
2005/0056841 A1 * 3/2005 Yamazaki et al. ..... 257/59
2007/0200803 A1 * 8/2007 Kimura ..... 345/76
2009/0270134 A1 * 10/2009 Yamazaki et al. ..... 455/566
2012/0181540 A1 * 7/2012 Udagawa et al. ..... 257/59

FOREIGN PATENT DOCUMENTS

JP 2001-035663 2/2001
JP 2001-109405 4/2001
JP 2001-332383 11/2001
JP 2004-006341 1/2004

* cited by examiner

*Primary Examiner* — Lun-Yi Lao
*Assistant Examiner* — Kelly B Hegarty
(74) *Attorney, Agent, or Firm* — Antonelli, Terry, Stout & Kraus, LLP.

(57) ABSTRACT

Provided is an image display device for displaying an image by causing a light emitting element to emit light, the light emitting element being disposed in each of a plurality of pixel areas which are defined by dividing a display area into a grid pattern, the image display device including a pixel circuit for controlling light emission of the light emitting element disposed in each of the plurality of pixel areas, the pixel circuit being formed in an area having a portion that protrudes from the pixel area of the pixel circuit toward an adjacent pixel area and a portion where an adjacent pixel area protrudes into the pixel area.

10 Claims, 6 Drawing Sheets

IMAGE DISPLAY DEVICE

CROSS-REFERENCE TO RELATED APPLICATION

The present application claims priority from Japanese application JP 2009-056501 filed on Mar. 10, 2009, the content of which is hereby incorporated by reference into this application.

BACKGROUND OF THE INVENTION

1. Field of the Invention

The present invention relates to an image display device that performs display control of pixels by causing light emitting elements such as organic electroluminescence elements to emit light.

2. Description of the Related Art

Some image display devices including organic electroluminescence display devices (hereinafter, referred to as organic EL display devices), which have organic electroluminescence elements (hereinafter, referred to as organic EL elements) as light emitting elements, perform display control of pixels by causing light emitting elements of the respective pixels to emit light. In this type of image display device, a light emitting element is disposed in each of a plurality of pixel areas which are defined by dividing a display area (display screen) into a grid pattern. The light emission of the light emitting elements is controlled on a pixel basis to display an image in the display area.

In order to make the light emitting element in each pixel area emit light at an arbitrary luminance, each pixel is provided with a pixel circuit, which contains a thin film transistor (TFT), a storage capacitor, and the like. Luminance information is written in the pixel circuit by means of signals supplied from the outside through a control signal line and a data signal line, and control is executed to make the light emitting element emit light at a luminance corresponding to the written luminance information.

Examples of the type of pixel circuit that is installed in an image display device are disclosed in JP 2001-035663 A, JP 2001-332383 A, JP 2001-109405 A, and JP 2004-006341 A. In image display devices disclosed in those documents, rectangular pixel areas are defined on a substrate by power supply lines, data signal lines, control signal lines, and the like, and a pixel circuit is disposed in each of the pixel areas to control the light emission of a light emitting element that is provided in the pixel area.

It is desirable that image display devices as those described above have small pixel area size in order to display a high-definition image. However, reducing the pixel area size relatively increases the area ratio of various circuit elements constituting a pixel circuit to the total pixel area. This makes it difficult for the image display devices, especially organic EL display devices and others where the number of circuit elements constituting a pixel circuit is large, to contain the circuit elements within a pixel area.

SUMMARY OF THE INVENTION

The present invention has been made in view of those circumstances, and it is therefore an object of the present invention to provide an image display device in which pixel circuits are arranged efficiently within a display area.

A representative aspect of the invention disclosed in this patent application is briefly summarized as follows.

(1) An image display device for displaying an image by causing a light emitting element to emit light, the light emitting element being disposed in each of a plurality of pixel areas which are defined by dividing a display area into a grid pattern, the image display device including a pixel circuit for controlling light emission of the light emitting element disposed in each of the plurality of pixel areas, the pixel circuit being formed in an area having a portion that protrudes from the pixel area of the pixel circuit toward an adjacent pixel area and a portion where an adjacent pixel area protrudes into the pixel area.

(2) The image display device according to item (1), in which first one of two adjacent pixel circuits sandwiching a power supply line, which supplies electric power for causing the light emitting element to emit light, protrudes toward a pixel area that is associated with second one of the two adjacent pixel circuits, and the second pixel circuit protrudes toward a pixel area that is associated with the first pixel circuit.

(3) The image display device according to item (1), in which the portion that protrudes toward the adjacent pixel area includes a margin portion for absorbing misalignment among layers that form the pixel circuit.

(4) The image display device according to item (1), in which the portion that protrudes toward the adjacent pixel area includes a gate electrode of a thin film transistor that constitutes the pixel circuit.

(5) The image display device according to item (1), in which the light emitting element includes an organic electroluminescence element, and in which the pixel circuit performs control to cause the organic electroluminescence element to emit light at a luminance corresponding to given luminance information.

DETAILED DESCRIPTION OF THE INVENTION

Hereinafter, an embodiment of the present invention is described in detail below with reference to the drawings.

The description given here takes as an example a case of applying the present invention to an organic EL display device, which is one of the modes of image display devices. A display panel of an image display device according to this embodiment includes an array substrate where pixel circuits containing organic EL elements, which are light emitting elements, are arranged in a matrix pattern and a sealing substrate which is bonded to the array substrate to seal the organic EL elements. Thin film transistors (TFTs) are formed on the array substrate. The light emission of the organic EL elements is controlled through the thin film transistors, and pixel-based display control is thus performed.

Figure 1:
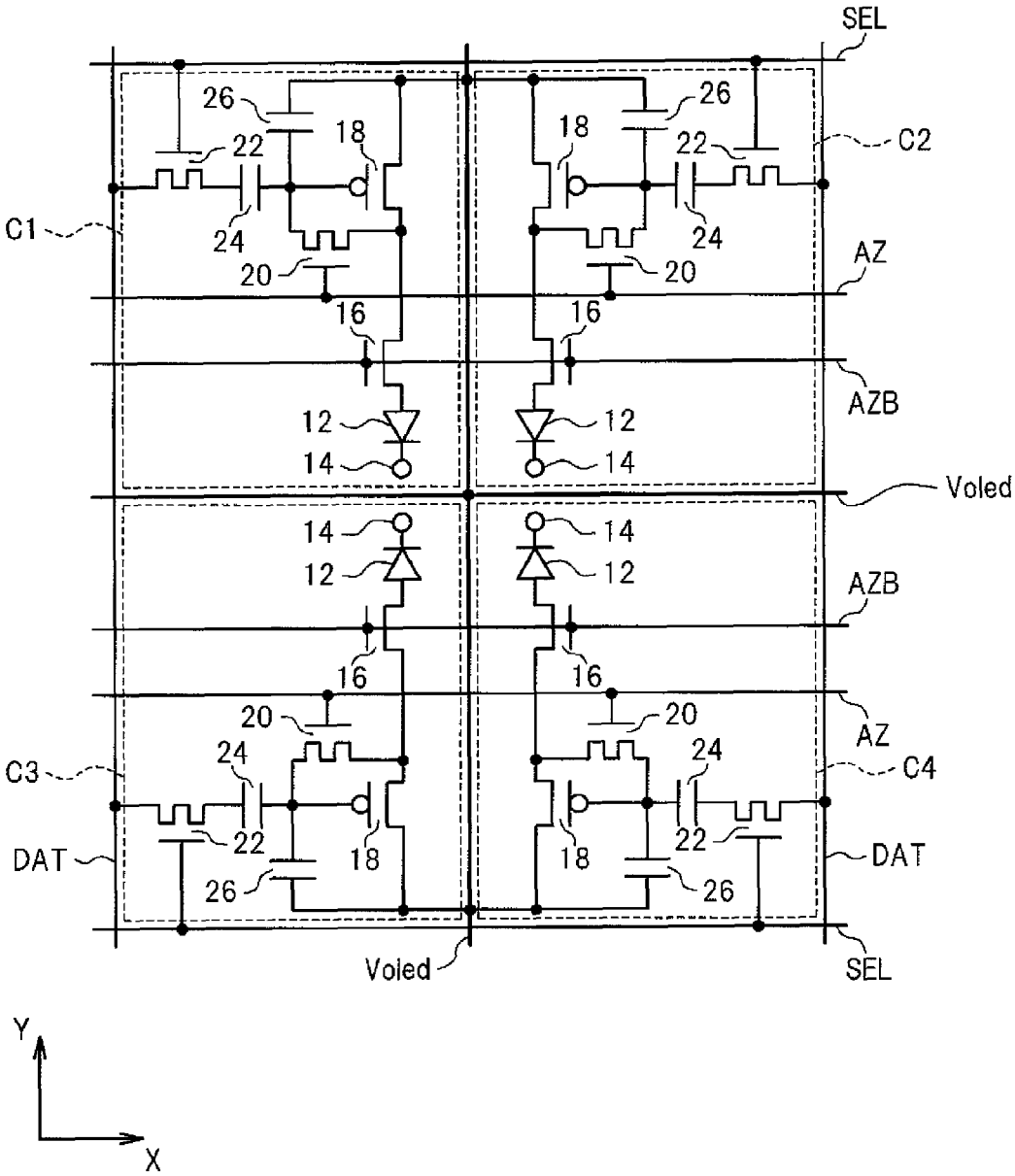
FIG. 1 is an equivalent circuit diagram of pixel circuits which are formed on an array substrate in an image display device according to an embodiment of the present invention.

FIG. 1 is a circuit diagram illustrating equivalent circuits of pixel circuits which are mounted onto the array substrate in the image display device according to this embodiment. As mentioned above, a plurality of pixel circuits C each containing a light emitting element are arranged in a matrix pattern within a display area of the image display device. Of those pixel circuits, FIG. 1 illustrates two rows by two columns of pixel circuits, four in total, C1, C2, C3, and C4.

As illustrated in FIG. 1, a data signal line DAT, a selection line SEL, an auto-zero input line AZ, an EL input line AZB, and a power supply line Voled are connected to each of the pixel circuits C. The data signal line DAT runs along a vertical direction of the display screen (Y axis direction of FIG. 1). A plurality of the data signal lines DAT are arranged in parallel to one another along a horizontal direction of the display screen (X axis direction of FIG. 1). The selection line SEL, the auto-zero input line AZ, and the EL input line AZB all run along the X axis direction. A plurality of the selection lines SEL, the auto-zero input lines AZ, and the EL input lines AZB are arranged in parallel to one another along the Y axis direction. In short, a plurality of the pixel circuits C that are aligned in the X axis direction constitute one pixel row, with one selection line SEL, one auto-zero input line AZ, and one EL input line AZB connected commonly to all the pixel circuits C that belong to the same pixel row. A plurality of the pixel circuits C that are aligned in the Y axis direction constitute one pixel column, with one data signal line DAT connected commonly to all the pixel circuits C that belong to the same pixel column.

Further, the power supply lines Voled are arranged in a grid pattern in the display area. In other words, a plurality of the power supply lines Voled run in the X axis direction and in the Y axis direction each in FIG. 1. The power supply lines Voled running in the X axis direction and the power supply lines Voled running in the Y axis direction are electrically connected to each other at their intersecting points. Power for driving light emitting elements in the respective pixel circuits C is supplied through the power supply lines Voled. Arranging the power supply lines Voled in a grid pattern in this manner reduces a drop in voltage supplied to each pixel through the power supply lines Voled which is caused by the electric resistance of the power supply lines Voled. In this embodiment, each of the plurality of power supply lines Voled running in the respective directions is placed for every two pixel columns or for every two pixel rows.

FIG. 1 illustrates only two rows by two columns of pixel circuits C, that is, four pixel circuits C in total, but actually, as many pixel circuits C as the number of pixels constituting the display panel are arranged in a matrix pattern on the array substrate. For example, in the case of a display panel that has a resolution of 640 pixels (lateral direction)×480 pixels (longitudinal direction) such as the ones used in digital still cameras and the like, each pixel is constituted of three sub-pixels which respectively correspond to red (R), green (G), and blue (B) colors, and one pixel circuit C is formed for each sub-pixel. The total number of the pixel circuits C formed on the array substrate is accordingly obtained as the product of 480 rows in the longitudinal direction and 640×3=1,920 columns in the lateral direction (480×640×3 pixel circuits). In the following description, each sub-pixel constituted of one pixel circuit C is simply referred to as pixel.

As illustrated in FIG. 1, the pixel circuit C of each pixel includes an organic EL element 12, which is a light emitting element, a common electrode 14, an EL switch 16, a driver TFT 18, an auto-zero switch 20, an input TFT 22, a cancellation capacitor 24, and a storage capacitor 26.

Each pixel circuit C is provided with the organic EL element 12 as the light emitting element, and a cathode end of the organic EL element 12 is connected to the common electrode 14. The common electrode 14 is an electrode having an electric potential set to a reference electric potential, which serves as the reference in the image display device according to this embodiment. An anode end of the organic EL element 12 is connected to one end of the EL switch 16, which is constituted of a TFT. The other end of the EL switch 16 is connected to the power supply line Voled via the driver TFT 18. When the driver TFT 18 and the EL switch 16 are both turned on, a current flows from the power supply line Voled into the organic EL element 12 toward the common electrode 14, to thereby cause the organic EL element 12 to emit light.

The auto-zero switch 20, which is constituted of a TFT, is connected between the other end of the EL switch 16 and a gate electrode of the driver TFT 18. The storage capacitor 26 is connected between the end of the driver TFT 18 that is connected to the power supply line Voled and the gate electrode of the driver TFT 18. Also connected to the gate electrode of the driver TFT 18 is one end of the cancellation capacitor 24. The other end of the cancellation capacitor 24 is connected to the data signal line DAT via the input TFT 22. A gate electrode of the EL switch 16, a gate electrode of the auto-zero switch 20, and a gate electrode of the input TFT 22 are connected to the EL input line AZB, the auto-zero input line AZ, and the selection line SEL, respectively. Control signals having two voltage levels, VH (high voltage) and VL (low voltage), are input from those control signal lines, to thereby switch the TFTs on and off.

A specific example of how the light emission of the organic EL element 12 is controlled in this embodiment is described. First, a control signal for turning the input TFT 22 on is input from the selection line SEL and, at the same time, control signals for turning the auto-zero switch 20 on and the EL switch 16 off are input from the auto-zero input line AZ and the EL input line AZB, respectively. This causes an off-level signal voltage which is being input to the data signal line DAT to be input to one end of the cancellation capacitor 24. With the auto-zero switch 20 turned on, the driver TFT 18 is connected by diode connection and the gate voltage of the driver TFT 18 is reset to a value corresponding to the applied voltage of the power supply line Voled.

After that, a control signal for turning the auto-zero switch 20 off is input from the auto-zero input line AZ, and a signal having a voltage level corresponding to given luminance information is input from the data signal line DAT simultaneously. The gate voltage of the driver TFT 18 consequently changes from the voltage at the time of reset, which serves as a reference, by a voltage that matches the voltage level input from the data signal line DAT. A control signal for turning the input TFT 22 off is further input from the selection line SEL, thereby keeping the gate voltage of the driver TFT 18 at this changed voltage and allowing the storage capacitor 26 to accumulate electric charges to an amount corresponding to the luminance information (i.e., the luminance information is written in the pixel circuit C). A control signal for turning the EL switch 16 on is then input from the EL input line AZB, which causes a signal current driven by the driver TFT 18 to flow into the organic EL element 12 through the EL switch 16, making the organic EL element 12 emit light. In this manner, each pixel circuit C turns the driver TFT 18 and the EL switch 16 on to make the organic EL element 12 emit light at a luminance corresponding to luminance information set through the data signal line DAT.

Figure 2:
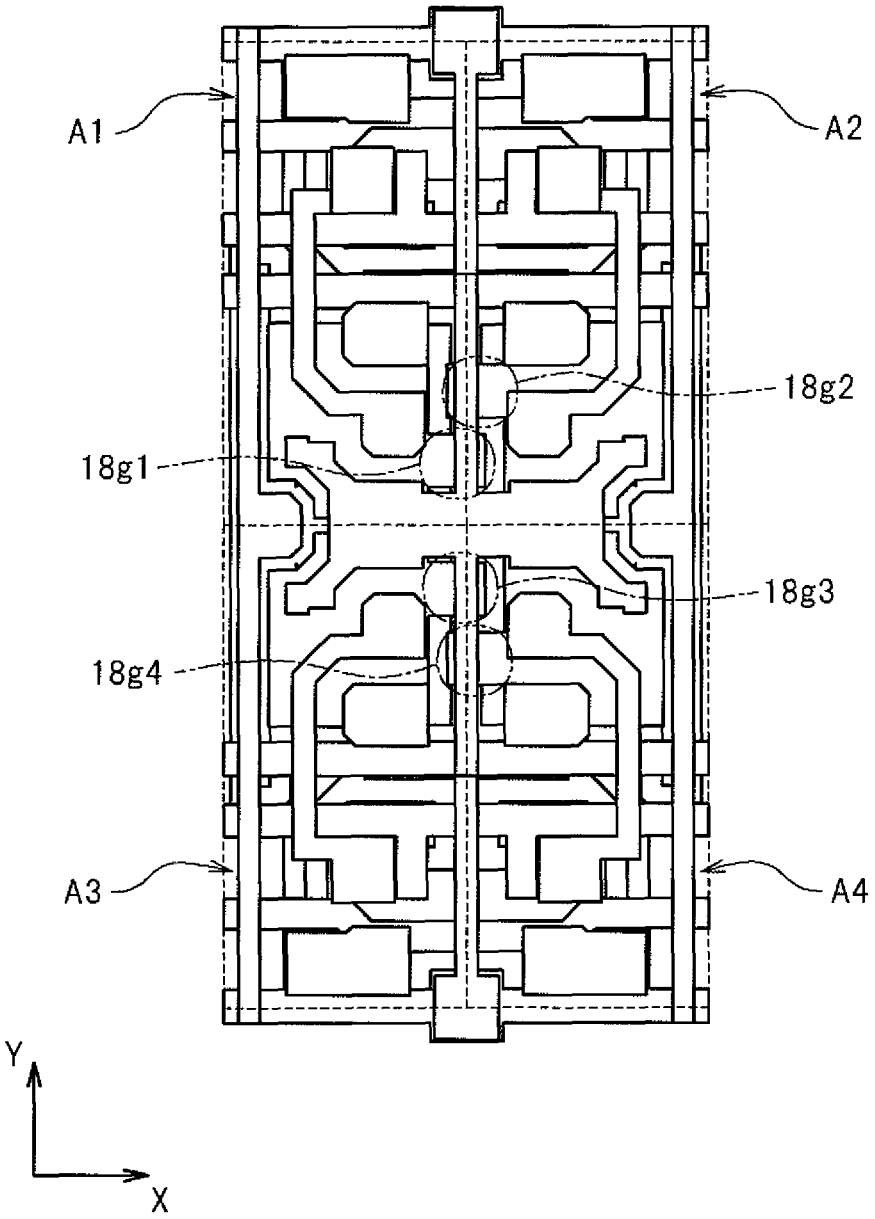
FIG. 2 is a plan view illustrating a structure of the pixel circuits which are formed on the array substrate in the image display device according to the embodiment of the present invention.

The structure of the pixel circuits mounted onto the array substrate in this embodiment is described next with reference to the plan view of FIG. 2. FIG. 2 is a diagram schematically illustrating in plan view the array substrate where TFTs constituting the pixel circuits of four pixels which correspond to the equivalent circuits of FIG. 1 are formed. FIG. 2 illustrates a state in which a polysilicon layer, a gate wiring/gate electrode layer, and an aluminum wiring layer have been layered in order. The TFTs and capacitors contained in the pixel circuits and the wiring lines connected to the pixel circuits are made from those layers. Though not illustrated in FIG. 2, a protective film, an insulating film, and the like are formed between those layers. A leveling film and a reflective layer as well as an anode, an organic EL layer, and a cathode which constitute the organic EL element 12 are added to the state illustrated in FIG. 2, thereby obtaining the array substrate. After that, the sealing substrate is attached to the array substrate in an $N_2$ environment with the substrates opposed to each other, whereby the manufacture of the display panel is completed.

Figure 3A:
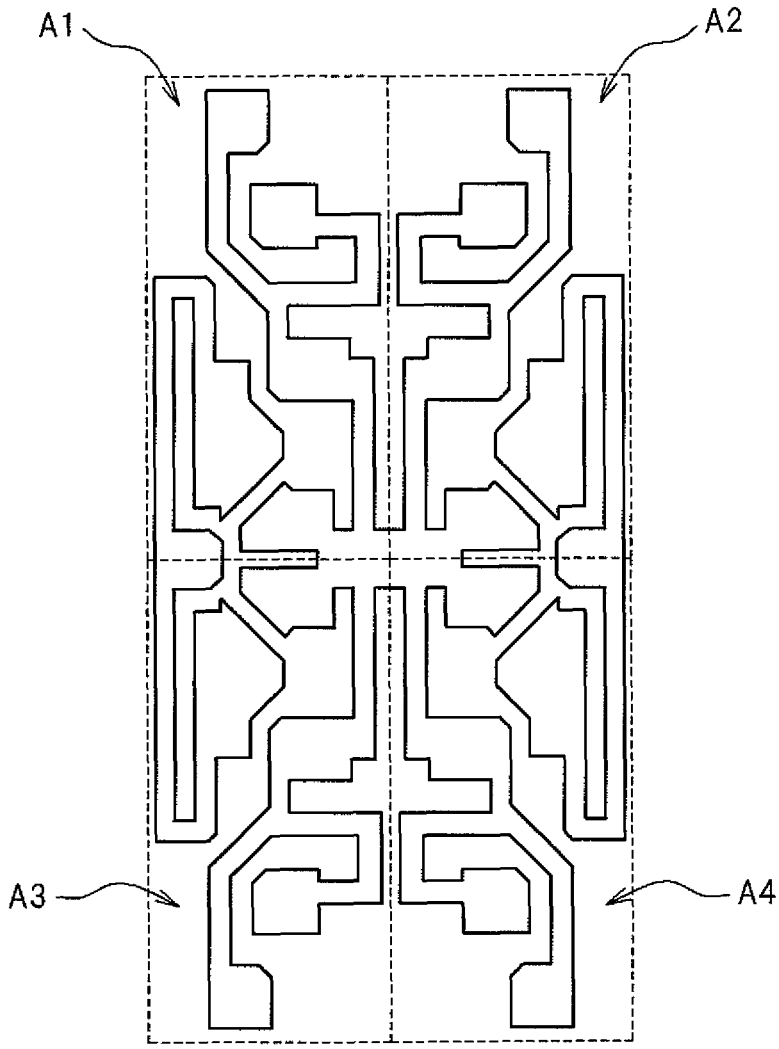
FIG. 3A is a plan view illustrating a shape of a polysilicon layer which is formed on the array substrate.
Figure 3B:
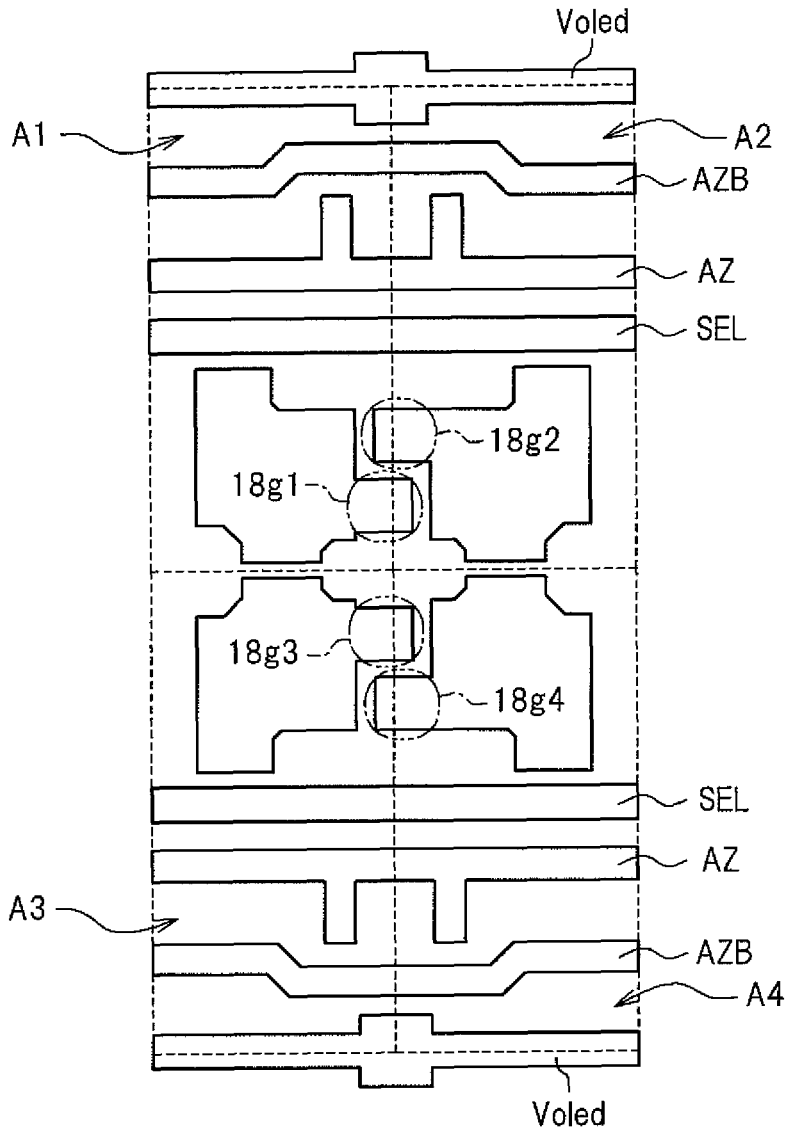
FIG. 3B is a plan view illustrating a shape of a gate wiring/gate electrode layer which is formed on the array substrate.
Figure 3C:
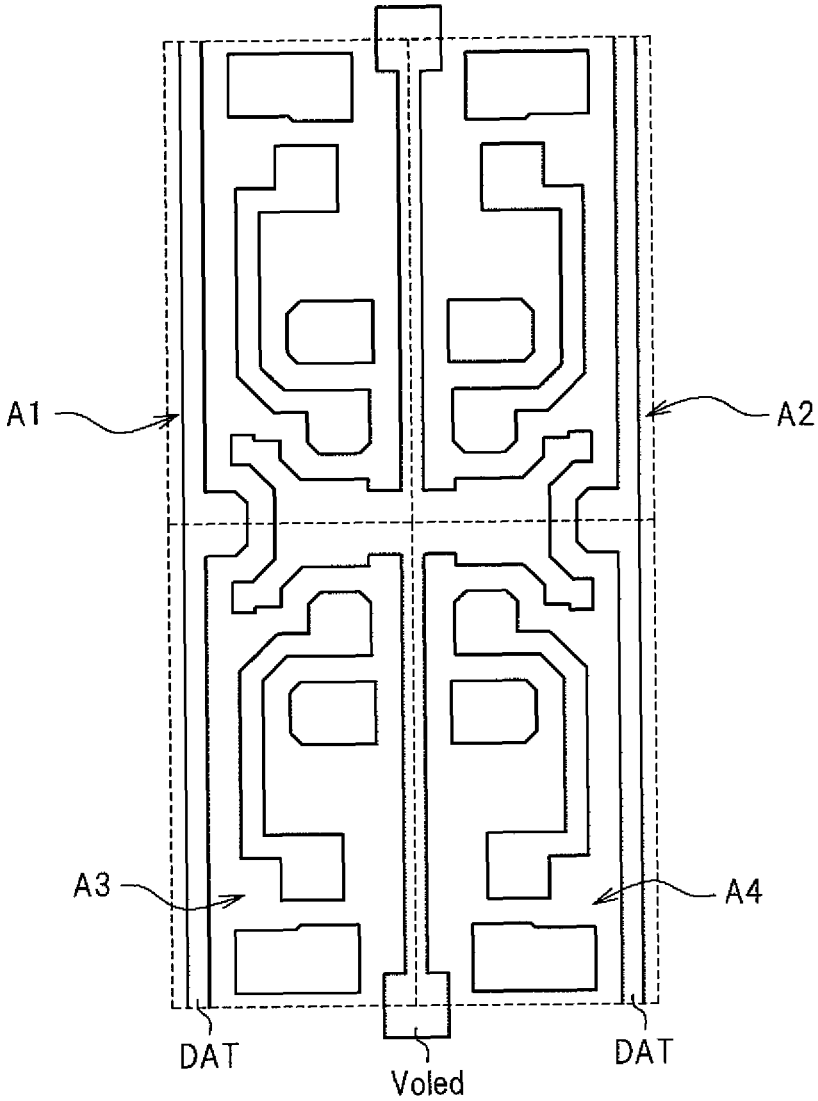
FIG. 3C is a plan view illustrating a shape of an aluminum wiring layer which is formed on the array substrate.

The shapes of the polysilicon layer, gate wiring/gate electrode layer, and aluminum wiring layer illustrated in FIG. 2 are illustrated in FIGS. 3A, 3B, and 3C, respectively. Specifically, FIGS. 3A to 3C are plan views illustrating the shapes of the layers that constitute the pixel circuits of, as in FIG. 2, four pixels, and FIG. 3A illustrates the shape of the polysilicon layer, FIG. 3B illustrates the shape of the gate wiring/gate electrode layer, and FIG. 3C illustrates the shape of the aluminum wiring layer.

The polysilicon layer is made of polysilicon (polycrystalline silicon), and functions as a semiconductor layer of the TFTs that are constituents of the pixel circuit C. The gate wiring/gate electrode layer is made of a metal material such as MOW, and functions as wiring lines including the auto-zero input line AZ, the EL input line AZB, and the selection line SEL, as the power supply line Voled that runs in the X axis direction, and as the gate electrodes of the constituent TFTs of the pixel circuit C. The aluminum wiring layer is made of aluminum and functions as the data signal line DAT, as the power supply line Voled that runs in the Y axis direction, and as the source and drain electrodes of the constituent TFTs of the pixel circuit C.

In this embodiment, the pixel area of each pixel is a rectangular area defined by dividing the entire display area into a grid pattern. The organic EL element 12 is disposed in each pixel area, and the pixel area lights in a given color at a given luminance by the emission of the organic EL element 12. Then, the pixel areas together display an image according to video signals which are input from the outside in the display area. FIG. 2 and FIGS. 3A to 3C each illustrate a plan view of two rows by two columns of pixel areas, four in total, A1, A2, A3, and A4, and the dashed lines in each drawing indicate the borders between the pixel areas. The light emission of the organic EL elements 12 respectively disposed in the pixel areas A1, A2, A3, and A4 is controlled by their respective pixel circuits C1, C2, C3, and C4. In other words, the pixel circuits C1, C2, C3, and C4 are associated with the pixel areas A1, A2, A3, and A4, respectively.

In this embodiment, the pixel circuit C for controlling the light emission of the organic EL element 12, which is disposed in each of the plurality of pixel areas A, is formed in an area that has a portion where this pixel circuit C protrudes toward an adjacent pixel area A and a concave portion where another pixel circuit C that is adjacent to this pixel circuit C protrudes toward the pixel area A of this pixel circuit C. Specifically, as illustrated in FIG. 2, two adjacent pixel circuits C1 and C2 sandwiching the power supply line Voled that runs in the Y axis direction share this power supply line Voled, and one of those pixel circuits (here, pixel circuit C1) partially protrudes toward the pixel area A2 which is associated with the other pixel circuit C2. The pixel circuit C2, on the other hand, is formed in an area containing a portion that protrudes toward the pixel area A1 which is associated with the pixel circuit C1. The pixel circuits C3 and C4 have a similar relation.

Making each pixel circuit C partially protrude toward the pixel area A adjacent to the pixel area A that is associated with this pixel circuit C in this manner improves the degree of freedom in layout of the pixel circuits C and allows efficient arrangement of the pixel circuits C within the display area. It should be noted that two adjacent pixel circuits C sandwiching the power supply line Voled that runs in the Y axis direction are formed to have an axisymmetric structure except portions that protrude toward their respective adjacent pixel areas A as illustrated in FIG. 2.

In each pixel circuit C, the gate electrode of the driver TFT 18 which is denoted by 18*g* is formed in the portion that protrudes toward an adjacent pixel area A. To give a specific example, a gate electrode 18*g*1, which is the gate electrode of the driver TFT 18 in the pixel circuit C1, protrudes toward the adjacent pixel area A2 past the power supply line Voled that is placed between the pixel area A1 and the pixel area A2. A gate electrode 18*g*2, which is the gate electrode of the driver TFT 18 in the pixel circuit C2, also protrudes toward the pixel area A1 past the power supply line Voled. Similarly, a gate electrode 18*g*3, which is the gate electrode of the driver TFT 18 in the pixel circuit C3, protrudes toward the adjacent pixel area A4, and a gate electrode 18*g*4, which is the gate electrode of the driver TFT 18 in the pixel circuit C4, protrudes toward the pixel area A3.

Further, the portion protruding toward an adjacent pixel area A is a margin portion of the gate electrode 18*g* which is designed so as not to overlap with the semiconductor layer of the driver TFT 18. Such margin portion is provided to ensure that the TFTs operate normally even when the polysilicon layer and the gate wiring/gate electrode layer that are actually formed on the array substrate are misaligned with each other. This embodiment assigns the margin portion of a constituent of one pixel circuit C to the portion that protrudes toward an adjacent pixel area A, thereby preventing this pixel circuit C from being affected by the operation of the pixel circuit C that is associated with the adjacent pixel area A.

Even if the gate electrode 18*g* of the driver TFT 18 overlaps with the polysilicon layer of the adjacent pixel circuit C due to misalignment, there is no fear of the operation of this driver TFT 18 affecting the operation of the adjacent pixel circuit C. This is because the driver TFT 18 functions as a switch element that switches the organic EL element 12 between light emission and no light emission as mentioned above, and the gate electrode 18*g* has a role of switching the switch element on and off according to the applied voltage. Therefore, if the gate electrode 18*g*1, for example, were to slightly affect the semiconductor layer of the driver TFT 18 in the adjacent pixel circuit C2, ultimately the switching on/off of the driver TFT 18 in the pixel circuit C2 would still depend on the voltage applied to the gate voltage 18*g*2. The portion that protrudes toward an adjacent pixel area A is thus assigned to a terminal portion where only whether the voltage is at the high level or the low level matters, such as the portion that is in charge of the on/off control of the switch element, instead of the portion where how high or low the voltage level is matters, such as the voltage that is input from the data signal line DAT and determined by luminance information. As a result, the risk of the portion that protrudes toward the adjacent pixel area A affecting the pixel circuit C that is associated with the adjacent pixel area A is reduced.

As has been described, pixel circuits can be arranged efficiently within a display area of an image display device according to this embodiment by forming each pixel circuit in an area that contains a portion protruding from its associated pixel area.

The image display device according to the embodiment described above may be employed as display devices for displaying various types of information, such as displays for personal computers, displays for receiving TV broadcasting, and displays for displaying advertisements. The image display device according to the embodiment described above may also be used as display parts of various electronic devices such as digital still cameras, video cameras, car navigation systems, car audio systems, game machines, and portable information terminals.

Figure 4:
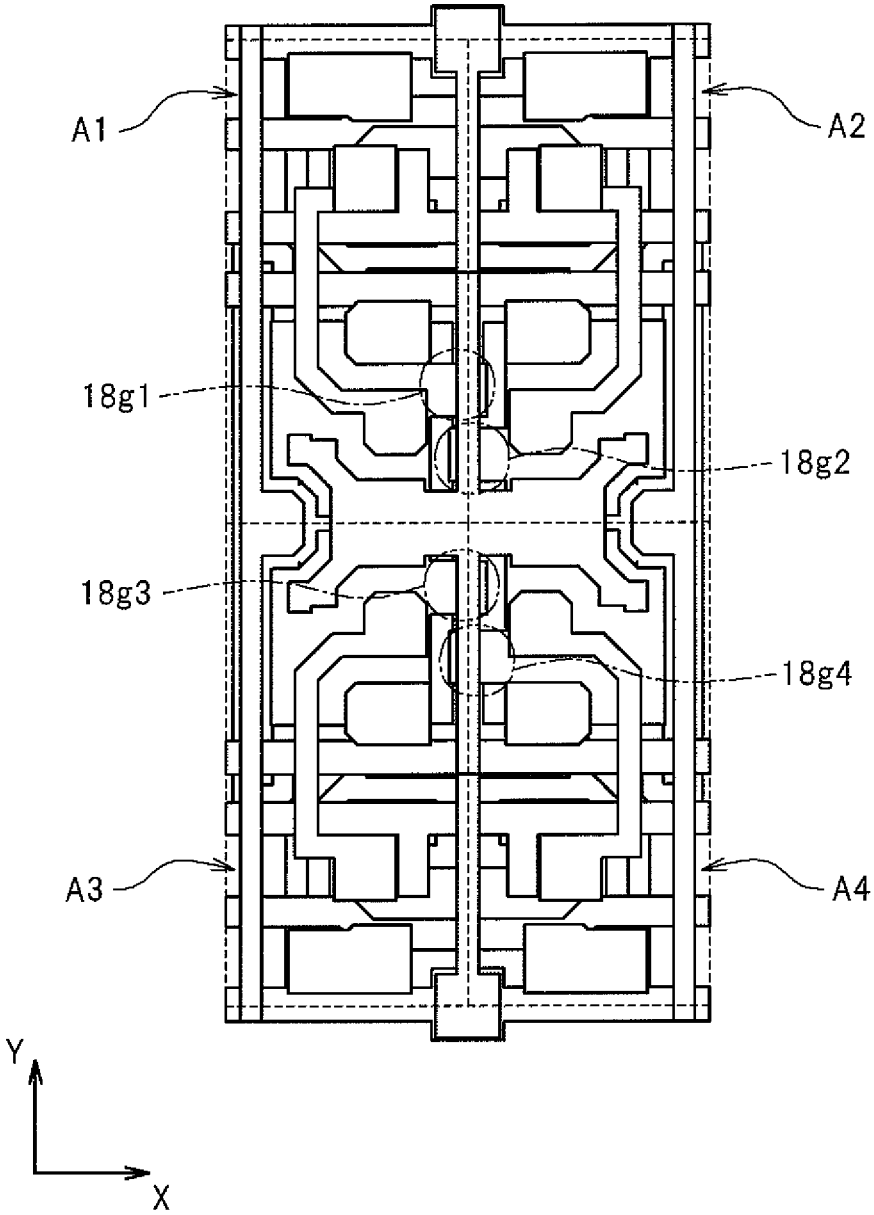
FIG. 4 is a plan view illustrating another structure of the pixel circuits which are formed on the array substrate.

The mode of carrying out the present invention is not limited to the embodiment described above. For instance, pixel circuits in the image display device according to the embodiment of the present invention may have a structure different from the one illustrated in FIG. 2. FIG. 4 illustrates the structure of the pixel circuits formed on the array substrate that differs from the pixel circuit structure of FIG. 2. In FIG. 2, pixel circuits placed above and below the border between the pixel areas A that runs in the X axis direction are axisymmetric with each other. In FIG. 4, on the other hand, the gate wiring/gate electrode layer has a different shape from the one illustrated in FIG. 2, and pixel circuits that are diagonally across from each other and sandwich an intersecting point between the borders of the pixel areas A that run in the X axis direction and the Y axis direction are formed to be symmetrical about the intersecting point. In the example of FIG. 4, too, the gate electrode 18*g* of the driver TFT 18 in each pixel circuit C protrudes into an adjacent pixel area A.

In the above description, an organic EL element is used as a light emitting element. However, the image display devices according to the embodiment of the present invention is not limited thereto and may use various light emitting elements, for example, inorganic EL elements and field emission devices (FEDs).

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image display device for displaying an image by causing a light emitting element to emit light, the light emitting element being disposed in each of a plurality of pixel areas which are defined by dividing a display area into a grid pattern, the image display device comprising a pixel circuit for controlling light emission of the light emitting element disposed in each of the plurality of pixel areas, the pixel circuit being formed in an area having one portion that protrudes from the pixel area of the pixel circuit toward an adjacent pixel area and another portion where an adjacent pixel area protrudes into the pixel area, wherein a first one of two adjacent pixel circuits sandwiching a power supply line, which supplies electric power for causing the light emitting element to emit light, has the one portion which protrudes directly underneath the power supply line toward the pixel area that is associated with a second one of the two adjacent pixel circuits, and the second pixel circuit has the another portion which protrudes directly underneath the power supply line toward the pixel area that is associated with the first pixel circuit; and wherein at least the one portion that protrudes directly underneath the power supply line toward the adjacent pixel area includes a gate electrode of a thin film transistor that constitutes the pixel circuit.

2. The image display device according to claim 1, wherein at least the one portion that protrudes directly underneath the power supply line toward the adjacent pixel area includes a margin portion for absorbing misalignment among layers that form the pixel circuit.

3. The image display device according to claim 1, wherein the light emitting element includes an organic electroluminescence element, and wherein the pixel circuit performs control to cause the organic electroluminescence element to emit light at a luminance corresponding to given luminance information.

4. The image display device according to claim 1, wherein each of the one portion and the another portion of the two adjacent pixel circuits is the gate electrode of the thin film transistor of the respective pixel circuit.

5. The image display device according to claim 1, wherein each of the one portion and the another portion of the two adjacent pixel circuits is a portion other than a capacitor or portion thereof of the two adjacent pixel circuits.

6. An image display device for displaying an image by causing a light emitting element to emit light, the light emitting element being disposed in each of a plurality of pixel areas which are defined by dividing a display area into a grid pattern, the image display device comprising a pixel circuit for controlling light emission of the light emitting element disposed in each of the plurality of pixel areas, the pixel circuit being formed in an area having one portion that protrudes from the pixel area of the pixel circuit toward an adjacent pixel area and another portion where an adjacent pixel area protrudes into the pixel area, wherein a first one of two adjacent pixel circuits sandwiching a power supply line, which supplies electric power for causing the light emitting element to emit light, has the one portion which protrudes directly underneath the power supply line toward the pixel area that is associated with a second one of the two adjacent pixel circuits, and the second pixel circuit has the another portion which protrudes directly underneath the power supply line toward the pixel area that is associated with the first pixel circuit; and wherein at least the one portion that protrudes directly underneath the power supply line toward the adjacent pixel area is an area of a gate electrode of a thin film transistor which does not overlap with a semiconductor layer of the thin film transistor.

7. The image display device according to claim 6, wherein at least the one portion that protrudes directly underneath the power supply line toward the adjacent pixel area includes a margin portion for absorbing misalignment among layers that form the pixel circuit.

8. The image display device according to claim 6, wherein the light emitting element includes an organic electroluminescence element, and wherein the pixel circuit performs control to cause the organic electroluminescence element to emit light at a luminance corresponding to given luminance information.

9. The image display device according to claim 6, wherein each of the one portion and the another portion of the two adjacent pixel circuits is the area of the gate electrode of the thin film transistor of the respective pixel circuit. (The dependency in the original claim order is changed).

10. The image display device according to claim 6, wherein each of the one portion and the another portion of the two adjacent pixel circuits is a portion other than a capacitor or portion thereof of the two adjacent pixel circuits.

* * * * *